US008800758B2

(12) United States Patent
Roberts

(10) Patent No.: US 8,800,758 B2
(45) Date of Patent: Aug. 12, 2014

(54) GIFT CARD CARRIERS

(75) Inventor: Jamie Roberts, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 1441 days.

(21) Appl. No.: 11/601,089

(22) Filed: Nov. 17, 2006

(65) Prior Publication Data

US 2008/0116088 A1 May 22, 2008

(51) Int. Cl.
*G09F 1/10* (2006.01)

(52) U.S. Cl.
USPC ..... 206/39.7; 206/459.5; 40/124.06; 235/486

(58) Field of Classification Search
USPC ..... 206/232, 39.7, 461, 459.5; 40/124.11, 40/124.12, 124.06, 124.09; 229/68, 71, 229/92.8; 283/100, 56, 61, 62, 63.1; 281/2, 281/5, 3.1; 235/379, 380, 486, 487
See application file for complete search history.

(56) References Cited

U.S. PATENT DOCUMENTS

| | | | |
|---|---|---|---|
| 846,064 | A | 3/1907 | Souder |
| 3,346,294 | A | 10/1967 | Sartz |
| 4,319,684 | A | 3/1982 | Backman et al. |
| 4,828,105 | A | 5/1989 | Silengo et al. |
| 5,036,645 | A | 8/1991 | Schwarz |
| 5,135,157 | A | 8/1992 | Cruz |
| 5,139,454 | A | 8/1992 | Earnest |
| 5,143,279 | A | 9/1992 | Gaines |
| 5,219,184 | A | 6/1993 | Wolf |
| 5,263,586 | A | 11/1993 | Keable |
| D344,757 | S | 3/1994 | Kruyt |
| 5,467,917 | A | 11/1995 | Potter |
| 5,516,033 | A | 5/1996 | Bernetich |
| 5,573,117 | A | 11/1996 | Adams |
| 5,575,384 | A | 11/1996 | Saye |
| 5,626,551 | A | 5/1997 | Kearns et al. |
| 5,641,115 | A | 6/1997 | Brewster |
| 5,645,214 | A | 7/1997 | Taganas |

(Continued)

FOREIGN PATENT DOCUMENTS

| | | |
|---|---|---|
| EP | 0725376 | 8/1996 |
| EP | 0927945 | 7/1999 |

(Continued)

OTHER PUBLICATIONS

Best Buy. Holiday Words Gift Card. Jan. 1, 2005. <http://web.archive.org/web/2005112406943/www.bestbuy.com/site/olspage.jsp?id=cat09000&type=category>.*

(Continued)

*Primary Examiner* — Anthony Stashick
*Assistant Examiner* — Ernesto Grano

(57) ABSTRACT

A first aspect pertains to a gift card carrier that also operates as a greeting card. A first folded configuration, the gift card carrier presents the gift card for purchase. In a second folded configuration, the gift card carrier acts like a greeting card that encloses the gift card. A second aspect pertains to a gift card carrier with a depression for receiving a gift card therein. The depression may make the gift card appear flush mounted within a panel of the gift card carrier. A third aspect pertains to a gift card carrier with an image of hardware device that includes a display, and a gift card that includes an image associated with the hardware device. The gift card is positioned over the display region of the hardware device image making it appear as if the gift card is the display, and the image thereon is being displayed.

17 Claims, 11 Drawing Sheets

(56) References Cited

U.S. PATENT DOCUMENTS 5,650,209 A 7/1997 Ramsburg et al.
5,687,992 A 11/1997 Finkelshteyn
5,755,375 A 5/1998 Rogers
5,760,381 A 6/1998 Stich et al.
5,791,474 A * 8/1998 Hansen ..... 206/449
D400,919 S 11/1998 Pickel
5,842,629 A 12/1998 Sprague et al.
5,845,425 A 12/1998 Leake et al.
5,862,979 A 1/1999 Hill et al.
5,906,063 A 5/1999 Magee, Sr.
5,918,909 A 7/1999 Fiala et al.
5,941,573 A 8/1999 Yordinsky
5,946,834 A 9/1999 Bradley
5,947,283 A 9/1999 Marshall
5,963,915 A 10/1999 Kirsch
5,963,916 A 10/1999 Kaplan
5,981,040 A 11/1999 Rich et al.
5,984,091 A 11/1999 Orr et al.
6,003,254 A 12/1999 Lorber
6,050,415 A 4/2000 Lind et al.
6,053,321 A 4/2000 Kayser
6,070,719 A 6/2000 Pollock
6,092,841 A * 7/2000 Best et al. ..... 283/56
6,199,912 B1 3/2001 Finkelshteyn
6,224,108 B1 5/2001 Klure
6,233,682 B1 5/2001 Fritsch
6,244,444 B1 6/2001 Jacobus et al.
D447,055 S 8/2001 Several et al.
6,270,012 B1 8/2001 Dawson
6,299,530 B1 10/2001 Hansted et al.
6,315,206 B1 * 11/2001 Hansen et al. ..... 235/487
6,349,829 B1 2/2002 Matheis et al.
D457,555 S 5/2002 Stephens-D'Angelo et al.
6,385,596 B1 5/2002 Ansell et al.
6,418,648 B1 7/2002 Hollingsworth et al.
6,457,638 B1 10/2002 Schmidt
6,491,213 B2 12/2002 Purcell
6,588,596 B1 7/2003 Holmes et al.
6,619,480 B2 9/2003 Smith
6,659,271 B2 12/2003 Parsons
6,698,116 B2 3/2004 Waldron
6,731,312 B2 5/2004 Robbin
6,877,263 B2 4/2005 Clark
6,957,737 B1 10/2005 Frederickson et al.
D512,456 S 12/2005 Diaz et al.
7,040,049 B2 5/2006 Cox et al.
7,055,740 B1 * 6/2006 Schultz et al. ..... 235/381
7,080,776 B2 7/2006 Lewis et al.
7,204,048 B2 4/2007 Kershner et al.
D541,647 S 5/2007 Ashby et al.
7,243,839 B2 7/2007 Beck et al.
D548,279 S * 8/2007 Gulakos ..... D19/4
7,277,870 B2 10/2007 Mourad et al.
7,278,584 B1 10/2007 Gandel et al.
7,322,519 B2 * 1/2008 Blank et al. ..... 235/380
7,367,504 B2 5/2008 Lewis et al.
7,374,095 B2 5/2008 Blank et al.
7,409,788 B2 * 8/2008 Lauer et al. ..... 40/594
7,490,720 B2 * 2/2009 Cole et al. ..... 206/232
7,500,604 B2 * 3/2009 Holme ..... 235/380
7,546,288 B2 6/2009 Springer et al.
7,584,887 B1 9/2009 Sanchez et al.
7,607,574 B2 10/2009 Kingsborough et al.
7,607,575 B2 * 10/2009 Kingsborough et al. ..... 235/380
7,712,741 B2 5/2010 Lambert
7,740,170 B2 6/2010 Singh et al.
7,822,640 B2 10/2010 Arthur et al.
7,837,125 B2 11/2010 Biskupski et al.
7,896,252 B2 3/2011 Narlinger et al.
8,256,682 B2 9/2012 Chakiris et al.
2001/0034703 A1 10/2001 Picciallo et al.
2001/0040115 A1 11/2001 Wani et al.
2001/0045738 A1 11/2001 Klure
2002/0002468 A1 1/2002 Geisler et al.
2002/0028321 A1 3/2002 Feilen et al.
2002/0080714 A1 6/2002 Pierson et al.
2002/0088855 A1 7/2002 Hodes
2002/0147683 A1 10/2002 Capobianco et al.
2002/0157974 A1 * 10/2002 Krahn ..... 206/308.1
2002/0195816 A1 12/2002 Anise
2003/0004889 A1 1/2003 Fiala et al.
2003/0018586 A1 1/2003 Krahn
2003/0066777 A1 4/2003 Malone
2003/0150142 A1 8/2003 Street
2003/0156686 A1 8/2003 Pines
2003/0230501 A1 12/2003 Smolev
2004/0064374 A1 4/2004 Cho
2004/0140361 A1 7/2004 Paul et al.
2004/0140616 A1 7/2004 Davis
2004/0254836 A1 12/2004 Barabas et al.
2004/0267622 A1 12/2004 Taylor et al.
2004/0268386 A1 12/2004 Logan et al.
2005/0017502 A1 1/2005 Chariker
2005/0100312 A1 5/2005 Commons et al.
2005/0167301 A1 8/2005 Oram
2005/0167910 A1 8/2005 Candler et al.
2005/0171795 A1 8/2005 Kearby et al.
2005/0182675 A1 8/2005 Huettner
2005/0279825 A1 12/2005 Ashby et al.
2006/0032764 A1 * 2/2006 Swenson ..... 206/232
2006/0042986 A1 3/2006 Simkowski
2006/0065748 A1 3/2006 Halbur et al.
2006/0086630 A1 4/2006 Cheong et al.
2006/0118618 A1 6/2006 Schultz et al.
2006/0157555 A1 * 7/2006 Dean et al. ..... 235/380
2006/0185201 A1 8/2006 Fachon et al.
2006/0212401 A1 9/2006 Ameerally et al.
2006/0224516 A1 10/2006 Lemon et al.
2006/0235864 A1 10/2006 Hotelling et al.
2006/0243609 A1 11/2006 Cole et al.
2006/0259189 A1 11/2006 Perlow et al.
2006/0261154 A1 11/2006 Arthur et al.
2007/0017973 A1 1/2007 Blank et al.
2007/0038577 A1 2/2007 Werner et al.
2007/0063052 A1 3/2007 Chakiris et al.
2007/0090184 A1 4/2007 Lockwood et al.
2007/0154167 A1 7/2007 Ando et al.
2007/0174200 A1 7/2007 Sung-Min et al.
2007/0187492 A1 8/2007 Graves et al.
2007/0198418 A1 8/2007 Macdonald et al.
2007/0208664 A1 9/2007 Ortega
2007/0224969 A1 9/2007 Rao
2007/0267502 A1 11/2007 Zellner et al.
2007/0278280 A1 12/2007 Wert et al.
2007/0289890 A1 12/2007 Appelbaum
2008/0052371 A1 2/2008 Partovi et al.
2008/0116088 A1 5/2008 Roberts
2008/0116089 A1 5/2008 Roberts
2008/0120609 A1 5/2008 Gates et al.
2008/0154722 A1 6/2008 Galinos
2008/0159715 A1 7/2008 Fuasaro et al.
2008/0188209 A1 8/2008 Dorogusker et al.
2008/0190267 A1 8/2008 Rechstein et al.
2008/0320139 A1 12/2008 Fukuda et al.
2009/0063292 A1 3/2009 Cole et al.
2009/0104539 A1 4/2009 Watanabe et al.
2009/0218392 A1 9/2009 Biskupski et al.
2009/0283594 A1 11/2009 Walton et al.
2010/0219099 A1 9/2010 Schmitt et al.
2010/0253063 A1 10/2010 Skogster
2011/0137793 A1 6/2011 Liggett
2012/0025516 A1 2/2012 Miller et al.
2012/0234909 A1 9/2012 Tang
2012/0259718 A1 10/2012 Miller et al.

FOREIGN PATENT DOCUMENTS

EP 1111562 6/2001
FR 2827981 1/2003
WO WO99/24942 A 5/1999
WO WO00/28461 5/2000
WO WO00/43852 7/2000
WO WO00/62265 10/2000
WO WO01/41023 6/2001

(56) References Cited

FOREIGN PATENT DOCUMENTS

| | | | |
|---|---|---|---|
| WO | WO01/44908 | | 6/2001 |
| WO | WO01/46786 | | 6/2001 |
| WO | WO01/50305 | | 7/2001 |
| WO | WO02/08869 | | 1/2002 |
| WO | WO03/007233 | | 1/2003 |
| WO | 2004/038567 | A | 5/2004 |
| WO | 2004/044770 | A | 5/2004 |

OTHER PUBLICATIONS

"Identification cards—Recording technique—Part 7: Magnetic Strip—High Coercivity, High Density", International Organization for Standardization, downloaded Dec. 26, 2007, 2 pgs.
"American National Standard Specifications for Credit Cards", American National Standards Institute, Inc. (ANSI), x4.13-1971, 1971, 18 pgs.
"American National Standard Magnetic-Stripe Encoding for Credit cards", American National Standards Institute, Inc. (ANSI), x4.16-1976, 1976, 12 pgs.
Offenberg, J. "Markets—Gift Cards", Journal of Economic Perspectives, vol. 21, No. 2, Spring 2007, pp. 227-238.
U.S. Appl. No. 11/849,802, entitled "Method and Apparatus for Purchasing Digital Playlists", filed Sep. 4, 2007.
U.S. Appl. No. 11/965,674, entitled "Methods and Systems for Encoding a Magnetic Stripe", filed Dec. 27, 2007.
U.S. Appl. No. 12/041,536, entitled "Multi-Pack Gift Card and Activation Thereof", filed Mar. 3, 2008.
U.S. Appl. No. 12/197,975, entitled "Carrier Card Arrangement with Removable Envelope", filed Aug. 25, 2008.
U.S. Appl. No. 12/262,097, entitled "Method for Assembling and Activating a Multi-Pack Package of Transaction Cards", filed Oct. 30, 2008.
"Identification Cards—Recording Technique", International Standard ISO/IEC, vol. 7811-2, No. Third Edition, Feb. 1, 2001, pp. 1-21.
Pottery Barn, Gift Cards, Web Page, downloaded Jun. 27, 2008, 1 pg.
"list." Dictionary of Publishing and Printing. London: A&C Black, 2006, www.credoreference.com/entry/acbpublishing/list, p. 1.
"listing." Collins English Dictionary. London: Collins, 2000, www.credoreference.com/entry/hcengdict/listing, p. 1.
"bin." Collins English Dictonary, London: Collins, 2000, www.credoreference.com/entry/hcengdict/bin, p. 1.
"rack 1",Collins English Dictonary, London, Collins 2000, www.credoreference.com/entry/hcengdict.rack_1, 1 pg.
"price", Chambers 21st Centruy Dictonary, London, Chambers Harrap, 2001, www.credoreference.com/entry/chambdict/price, 1 pg.
"allow", Webster's Third New International Dictionary, Merriam-Webster, downloaded Jul. 14, 2009, http://lionreference.chadwyck.com/searchFulltextdo?id=871261&idType=offset&divLevel=2&queryId../sessions/1247680262_19043&area=mwd&forward=refshelf&trail=refshelf, 2 pg.
"value", Webster's Third New International disconary, Merriam-Webster, Incorporated, downloaded Jul. 15, 2009, http://lionreference.chadwyck.com/searchFulltext.do?id=38664807&idTyple=offset&divLevel=2&queryID=../session/1247683362_2487&area=mwd&forward=refshelf&trail=refshelf, p. 4.
"media", Chambers 21st Century Dictionary, London, Chambers Harrap, 2001, downloaded Jul. 15, 2009, www.credoreference.com/entry/chambdict/media.com, 1 pg.
"associate", Collins English Dictionary, London, Collins 2000, www.credoreference.com/entry/hcengdict/associate, 1 pg.
"active", Webster's Third New International Dictionary, Merriam-Webster, Inc., downloaded Jul. 16, 2009, http://lionreference.chadwyck.com/searchFulltext.do?id=313560&idType=offset&divLevel=2&queryID../session/1247778592_27918&area=mwd&forward=refshelf&trail=refshelf, 3 pg.
"activate", Webster's Third New International Dictionary, Merriam-Webster, Inc., downloaded Jul. 16, 2009, http://lionreference.chadwyck.com/searchFulltextdo?id=312239&idType=offset&divLevel=2&queryID../session/1247778879_29216&area=mwd&forward=refshelf&trail=refshelf, 2 pg.
The Bank Credit Card Business, 2nd Edition, American Bankers Association, Washington D.C., 1996, pp. 1-13, 63-89.
Smart Card Handbook, 2nd Edition, W. Rankl and W. Effing, John Wiely and Sons, West Sussex, England, 2000, pgas 1-25.

* cited by examiner

GIFT CARD CARRIERS

CROSS REFERENCE TO RELATED APPLICATIONS

This application is related to U.S. patent application Ser. No. 11/115,047 entitled "GREETING CARD SYSTEM INCLUDING WINDOW TO ALLOW FOR INVENTORY AND ACTIVATION" filed Apr. 25, 2005, which is herein incorporated by reference.

BACKGROUND OF THE INVENTION

1. Field of the Invention

The present invention relates generally to gift cards and their carriers. More particularly, the present invention relates to improved packaging of gift cards via gift card carriers.

2. Description of the Related Art

Gift cards are legal tender purchased for use by a person and usable in its face amount in lieu of cash in exchange for goods or services supplied by the seller. They are similar to credit cards in makeup except that they have a banked dollar value. Gift cards may designate the amounts contained therein, or they may be programmable to any value, i.e., varying amounts may be assigned to the gift card at time of purchase. Gift cards are typically given as gifts in lieu of a physical present.

Gift cards are generally associated with particular retail store, i.e., the gift card can only be used at that store. Alternatively, the gift cards may be issued by financial institutions such as bank or credit card companies. These cards are generally accepted anywhere the institution is accepted, i.e., they act like a credit card.

Gift cards are typically formed from a plastic material that includes a magnetic strip or bar code strip on its back surface. The magnetic strip or bar code contains the dollar amount of the gift card. The gift cards may also include a code with a dollar amount assigned thereto. When used at a brick and mortar store as for example by swiping the strip at a register, the amount is typically reduced by the purchase price of the item being purchased. When used at an online store as for example be entering the code, the original amount may be assigned to a particular user account, and thereafter this amount can be reduced by the purchase price of the item being purchased.

Gift cards may also include information about the seller of the gift card on its front surface (e.g., logos, company name, etc.). The front surface of the gift cards may additionally or alternatively include random images, patterns or colors in order to make the gift cards more presentable and thus more like gifts. The back surface of the gift card may also include terms and conditions of the gift card, direction on how to use the gift card, and possibly the store title and original amount of the gift card.

The gift cards are typically packaged so that they can be placed on a display rack. In most cases, the plastic gift card is glued to a piece of cardboard backing such that the front surface of the gift card is in full view. The cardboard backing typically includes a hole so that the gift cards can hang from the display rack. The card board backing also typically includes decoration or ornamentation such as a store logo.

While this arrangement works, it is desirable to improve the packaging and aesthetical appearance of the gift cards and their carriers in order to make them appear more gift like. It is believed that this will increase sales of gift cards as well as make the recipient feel better about their gift (e.g., more thoughtful gift). Thus, there is a need for improved arrangements of gift cards/gift card carriers.

SUMMARY OF THE INVENTION

The invention relates, in one embodiment, to a gift card carrier. The gift card carrier includes a panel that has a surface with a hardware image disposed thereon. The hardware image represents at least a portion of a hardware device. The portion of the hardware device that is imaged on the panel includes a display region of the hardware device. The display region of the hardware image defines an area for mounting a gift card.

The invention relates, in another embodiment, to a gift card carrier. The gift card carrier includes a panel that has a front surface with an image of a hardware device capable of displaying digital images disposed thereon. The image of the hardware device including at least a display region of the hardware device. The gift card carrier also includes a gift card mounted to the front surface of the panel over the display region of the image of the hardware device. The gift card has a front surface with an image disposed thereon. The image is related to the image of the hardware device.

The invention relates, in another embodiment, to a method of manufacturing a gift card carrier. The method includes providing one or more panels. The method also includes placing an image of at least a display portion of a hardware device on a first panel of the one or more panels. The display portion of the hardware device includes at least a display of the hardware device dedicated to displaying digital images. The method further includes attaching a gift card to the first panel over the display portion of the hardware device so that an image printed on the gift card appears as if it is being displayed on the imaged hardware device.

The invention relates, in another embodiment, to a gift card carrier that acts like a greeting card. The gift card carrier includes a plurality of panels capable of folding over each other. The panels fold to at least a first folded configuration that places a gift card at the front surface of the gift card carrier so that it can be viewed, and a second folded configuration that places the gift card inside the plurality of panels so that the gift card is hidden from view.

BRIEF DESCRIPTION OF THE DRAWINGS

The invention may best be understood by reference to the following description taken in conjunction with the accompanying drawings in which.

DETAILED DESCRIPTION OF THE INVENTION

The invention pertains to improved gift card carriers. More particularly, a first aspect pertains to a gift card carrier that also operates as a greeting card. In a first folded configuration, the gift card carrier presents the gift card for purchase. In a second folded configuration, the gift card carrier acts like a greeting card that encloses the gift card, and possibly supplies a greeting or message. A second aspect pertains to a gift card carrier with a depression for receiving a gift card therein. The depression may make the gift card appear as if its flush mounted within a panel of the gift card carrier. A third aspect pertains to a gift card carrier with an image of hardware device that includes a display, and a gift card that includes an image associated with the hardware device. The gift card is positioned over the display region of the hardware device image making it appear as if the gift card is the display, and the image thereon is being displayed. In one particular embodiment, content that can be purchased and played on the hardware device as for example media items such as audio and video is disposed on the gift card.

Embodiments of the invention are discussed below with reference to FIGS. 1-13. However, those skilled in the art will readily appreciate that the detailed description given herein with respect to these figures is for explanatory purposes as the invention extends beyond these limited embodiments.

Figure 1:
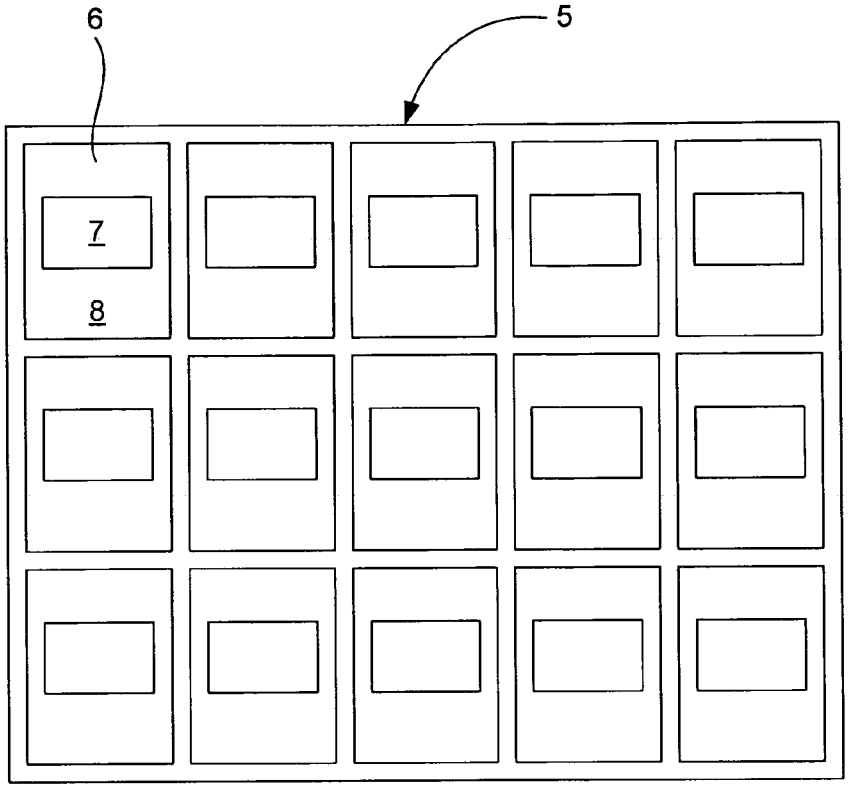
FIG. 1 is an exemplary diagram of a gift card display.

FIG. 1 is a diagram of a gift card display 5, which can be found at a store. The gift card display 5 can be a virtual or physical display depending on the type of store (e.g., brick and mortar, online, etc.). The gift card display 5 generally contains and presents a plurality of gift card carriers 6, each of which contains a gift card 7 for purchase. The gift card carriers 6 may for example hang from posts or they may be supported by a stand. The gift cards 7 generally contain varying amounts of credit to be purchased. In some cases, however, the amount of credit may be programmable as for example when the gift card 7 is purchased. The credit can be used at the store at a later date to purchase merchandise at the store, whether locally in a brick and mortar building or remotely through an online store front. The gift cards 7 and carriers 6 may come in variety of different sets, each set having different ornamentation and/or bank value. For example, each set can have different colors, patterns, etc and/or different dollars values such as $10, $15, $25, $50 etc. In most cases, within one set, the attributes of the gift card match the attributes of the gift card carrier (e.g., have the same pattern or color).

The gift card carrier 6 can present the gift cards 7 in a variety of ways. The gift cards 7 may be attached to the carriers 6 using any suitable technique including for example and not by way of limitation glue, tape, clips, slits, pockets, lips, etc. In some cases, the gift cards 7 may even be partially die cut into the carrier 6 from a single integral member. Furthermore, the gift card carrier 6 may include any number of panels 8. In some cases, the gift card carriers 6 include a single panel 8. In these cases, the gift cards 7 are typically mounted to the front side of the panel. In other cases, the gift card carriers 6 include multiple panels 8 as for example, two or three panels (and possible more). In cases such as these, the gift card 7 is typically attached to one of the panels while the remaining panels fold around the gift card 7. During presentation, the panel 8 with the gift card 7 is typically located at the front of the carrier 6 so that it can be easily seen.

The gift card carriers 6 may be formed from a variety of materials. For example, the various panels of the gift card carrier 6 may be formed from one or more sheets, which may be formed from one or more layers of material. The sheet materials may for example include plastics, paper, cardboard, fabric, and/or the like. In essence, any suitable card like material may be used.

According to a first aspect of the invention, a gift card carrier that also operates as a greeting card (or vice versa) is provided. In this embodiment, the gift card carrier includes at least two foldable panels. In a first folded configuration of the gift card carrier, the gift card carrier acts as packaging for the gift card. The gift card carrier is folded in such a way that the gift card is visible to the purchaser. The purchaser can therefore browse through different gift card images until the desired gift card image is found. For example, the user can find a gift card that has some relation to the person who the purchaser is going to give the gift card. In a second folded configuration of the gift card carrier, the gift card carrier no longer acts as packaging but rather as a greeting card that can be given to the desired recipient. The gift card carrier is folded in such a way that the gift card is hidden behind the panels and further the front of the panel includes features that make it greeting card like (e.g., message, greeting or image). This is believed to be more aesthetically pleasing thereby making the purchaser/recipient feel better about giving/receiving a gift card (e.g., makes it more personal). In addition, in some cases, the purchaser no longer has to buy a separate greeting card.

Figure 2A:
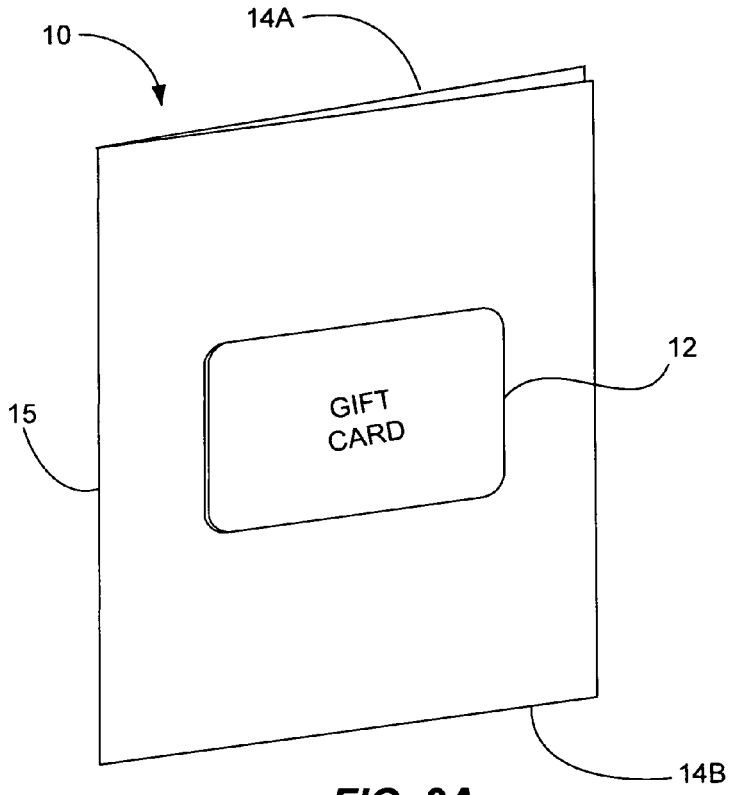
FIGS. 2A-2B are perspective diagrams of a gift card carrier, in accordance with one embodiment of the present invention.
Figure 2B:
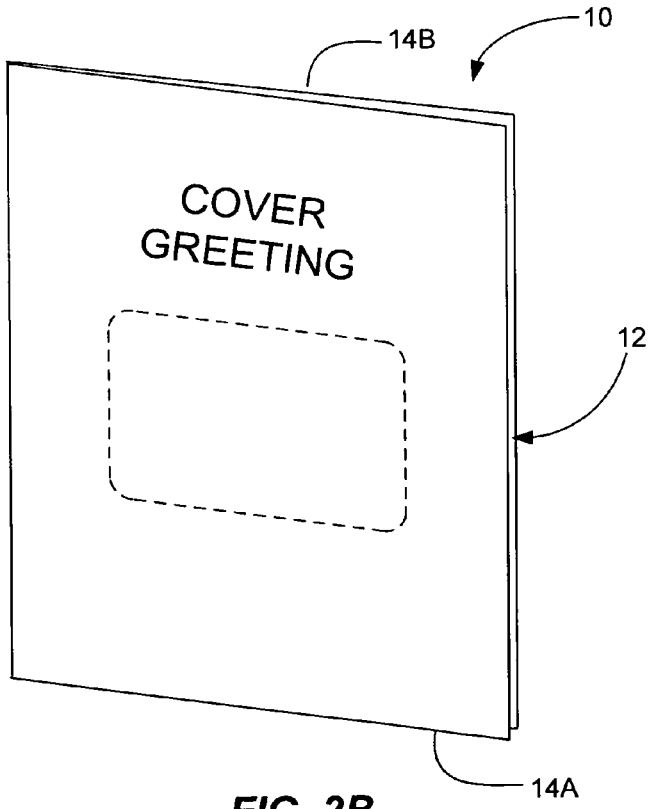

FIGS. 2A-2B and 3A-3B are diagrams of a gift card carrier 10, in accordance with one embodiment of the present invention. The gift card carrier 10 may for example correspond to the gift card carriers found on the gift card display of FIG. 1. The gift card carrier 10 is configured to visibly display a gift card 12 for purchase (FIG. 2A) and then fold back onto itself to become a greeting card that encloses the gift card 12 therein thereby hiding it from view (FIG. 2B).

As shown in FIGS. 2A-3B, the gift card carrier 10 includes at least two panels 14A and 14B that pivot relative to one another. The panels 14A and 14B may be separate panels that are pivotally connected together or they may be integrally formed from a single sheet that includes a fold line 15 (as shown). In either case, the panels 14 are configured to swing between a first folded configuration as shown in FIG. 2A, and swing back to a second folded configuration as shown in FIG. 2B. In the first folded configuration, the gift card 12 is presented for viewing at the front of the panels 14 of the carrier 10 and in the second folded configuration the gift card 12 is enclosed inside the panels 14 of the carrier 10.

The panel 14A that folds over the panel 14B including the gift card 12 is typically configured to be large enough to cover the gift card 12 in its entirety when the panels 14 are closed. In most cases, the two panels 14A and 14B have the same size and shape although this is not a requirement. In some circumstances, for example, the panel 14 that folds over gift card 12 is smaller than the panel 14 that includes the gift card 12.

Figure 3A:
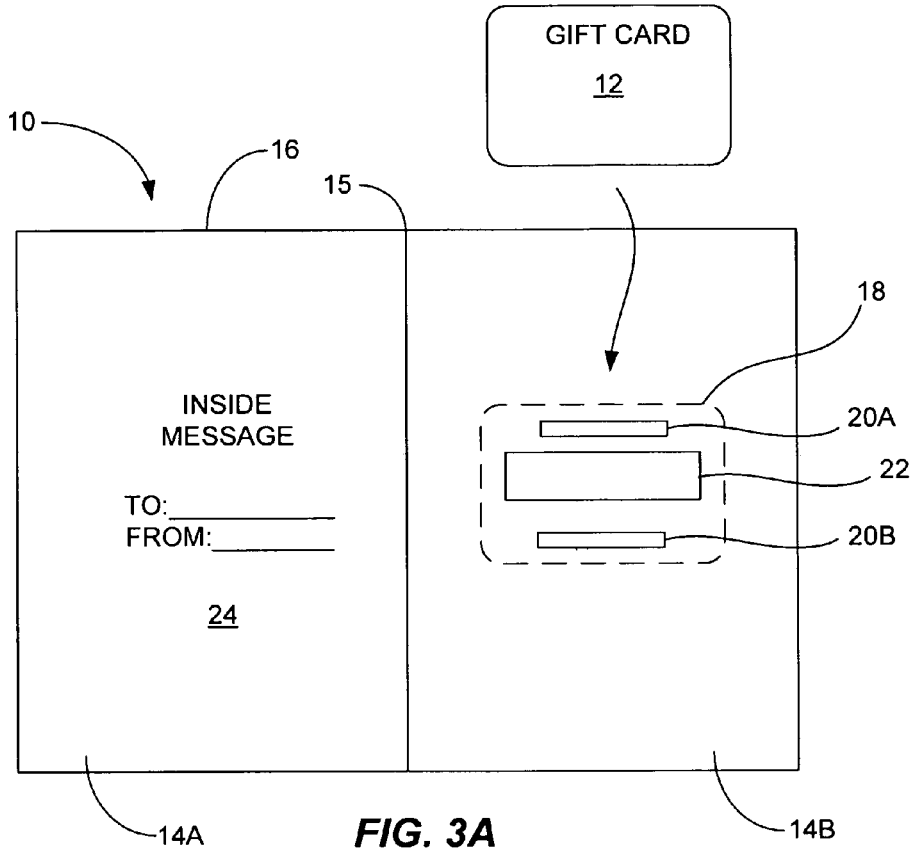
FIGS. 3A-3B are front and back diagrams of the gift card carrier of FIGS. 2A and 2B, in accordance with one embodiment of the present invention.

On a first side 16 of the carrier 10, as shown in FIG. 3A, the second panel 14B includes a gift card mounting area 18 that has one or more retention mechanisms 20 disposed thereon. The retention mechanisms 20 are configured to hold the gift card 12 against the second panel 14B thus securing the gift card 12 to the second panel 14B. The retention mechanisms 20 may for example include glue, tape, clips, slits, pockets, and/or the like. In the illustrated embodiment, a first retention mechanism 20A is placed at an upper portion of the mounting area 18 and a second retention mechanism 20B is placed at a lower portion of the mounting area 18. By way of example, the retention mechanisms 20 may be double sided tape.

Although not a requirement, the second panel 14B may additionally include a scan window 22 disposed within the mounting area 18. The scan window 22, which is typically a small opening formed in the second panel 14B, provides access to the back surface of the gift card 12 when the gift card 12 is placed over the mounting area 18. The scan window 22 may for example provide access to a scan bar disposed on the back surface of the gift card 12. The scan bar may for example be a magnetic strip or bar code. The scan window 22 is typically sized and dimensioned to expose the entire scan bar. As such, the gift card 12 doesn't have to be removed from the carrier 10 when the gift card 12 is purchased.

Still referring to FIG. 3A, the first panel 14A may include a message, greeting or artwork 24 printed thereon. Thus, when the recipient receives the greeting card and opens it up, they are presented with a message 24 on one panel a the gift card 12 on the other. In the illustrated embodiment, the first panel 14A includes a simple TO/FROM message, which can be filled in by the purchaser before they give the greeting card to the recipient. It should be appreciated however that a message or greeting 24 is not a requirement. In some cases, it may be desirable to leave the first panel 14A blank. Moreover, in some embodiments, the second panel 14B may also include messages, greetings or artwork, which may or may not relate in some way to the gift card attached thereto.

Figure 3B:
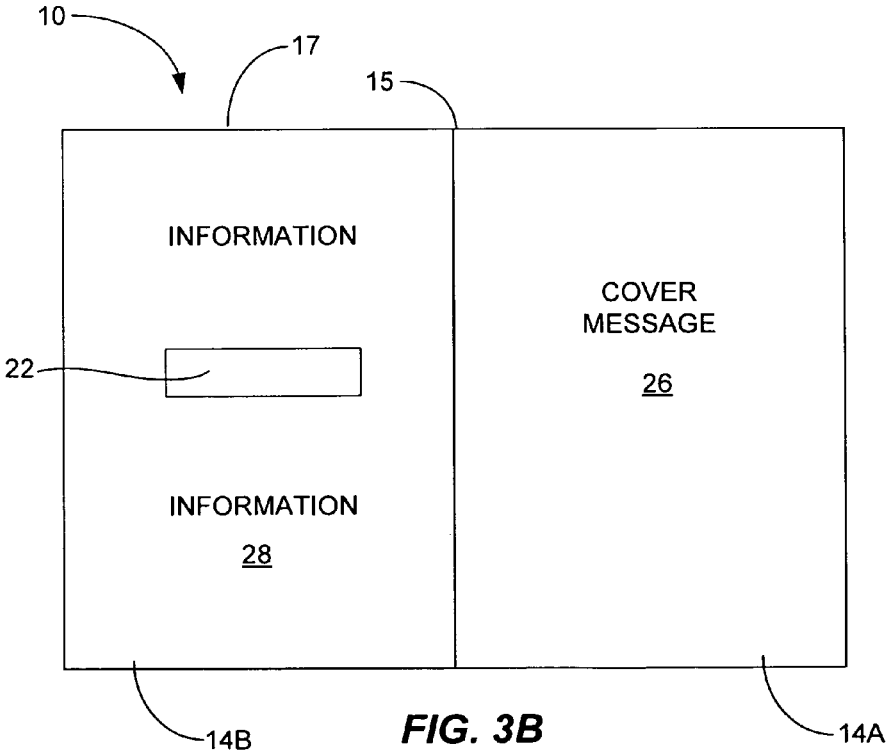

On a second side 17 of the carrier 10, as shown in FIG. 3B, the first panel 14A is configured as the front page or title page of the greeting card. Therefore, the first panel 14A may include a message, greeting, or artwork 26 printed thereon. It should be appreciated however that a message or greeting or artwork 26 is not a requirement. In some cases, it may be desirable to leave the first panel 14A blank.

Still referring to FIG. 3B, the second panel 14B may include gift card information 28 printed thereon (opposite side of gift card). For example, it may include terms and conditions of the gift card 12. It may also include direction on how to redeem the gift card 12. It may also include a bar code for tracking and possibly purchasing the gift card 12.

Alternatively or additionally, any of the panels on any of its sides may have images patterns and/or colors that matches or is related to the images, patterns and/or colors on gift card.

Alternatively or additionally, any of the panels on any of its sides may have images, patterns and/or colors associated with the company issuing the gift card.

Some features of this aspect of the invention (e.g., bar code window) can be found in U.S. patent application Ser. No. 11/115,047, which is herein incorporated by reference.

Figure 4:
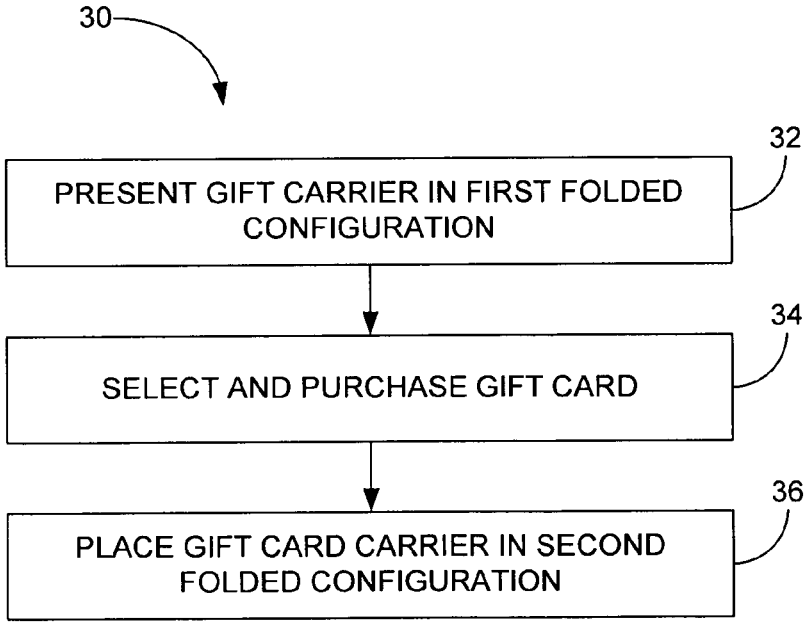
FIG. 4 is a method of packaging a gift card, in accordance with one embodiment of the present invention.

FIG. 4 is a method 30 of packaging a gift card, in accordance with one embodiment of the present invention. The gift card may for example be carried by the combination gift card carrier/greeting card disclosed in FIGS. 2 and 3.

The method 30 begins at block 32 where a gift card carrier is presented in a first fold configuration (FIG. 2A). The first fold configuration places the gift card on the outside of the gift card carrier thus making the front of the gift card viewable to consumers browsing for the desired gift card image printed on the gift card. While in the first folded configuration, the gift card carrier may for example be placed in a display rack as described in FIG. 1.

Once the desired gift card is found, the gift card can be purchased in block 34. During a purchase, the store clerk folds back the panels of the gift card carrier from the first folded configuration in order to expose the scanning window and scanning bar of the gift card which was previously hidden from view. The store clerk then scans the scanning bar in order to activate the gift card as well as ring up the gift card on the register. As should be appreciated, prepaid cards purchased at a retail store location have no value until activated at the register.

Before the gift card is given to its intended recipient, the panels of the gift card carrier are swung to a second folded configuration in block 36, which makes the gift card carrier act like a greeting card. The second configuration places the gift card on the inside of the gift card carrier thus hiding it from view. Furthermore, it may place a message on the outside of the gift card carrier, which further gives it the appearance of a greeting card. Once folded, the greeting card is typically placed into an envelope or sealed with a sticker or other mechanism such as a ribbon. The gift card/greeting card can then be given to the intended recipient as a gift. In most cases, the purchaser writes a message or signs their name inside the gift card carrier (e.g., panel adjacent the gift card) before placing it in the second folded configuration.

According to a second aspect of the invention, a gift card carrier with a depression for receiving a separately formed gift card therein is provided. The depression allows the gift card to be recessed within a surface of a panel of the gift card carrier rather than being placed outside the surface of the panel of the gift card carrier. Placing the gift card within the depression helps retain the gift card to the gift card carrier as well as enclose the gift card within the gift card carrier. In some cases, the depth of the depression can place the front surface of the gift card substantially flush or level with the front surface of the panel. This may be referred to as flush mounting. Flush mounting is believed to be more aesthetically and functionally pleasing thus helping increase sales of the gift card/gift card carrier.

Figure 5A:
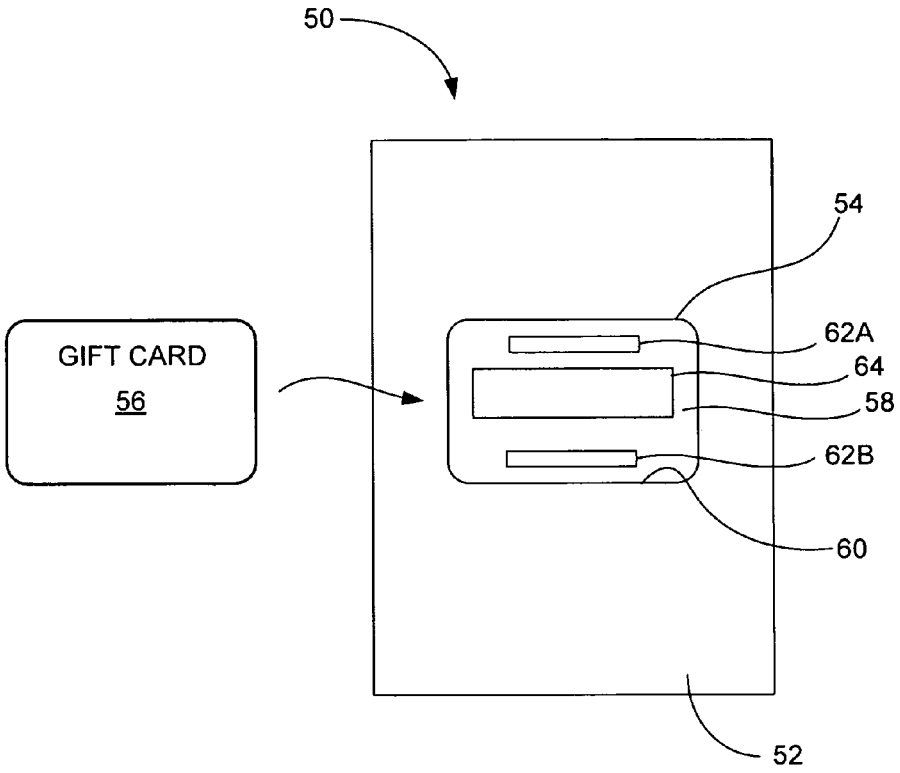
FIGS. 5A-5C are diagrams of a gift card carrier, in accordance with one embodiment of the present invention.
Figure 5B:
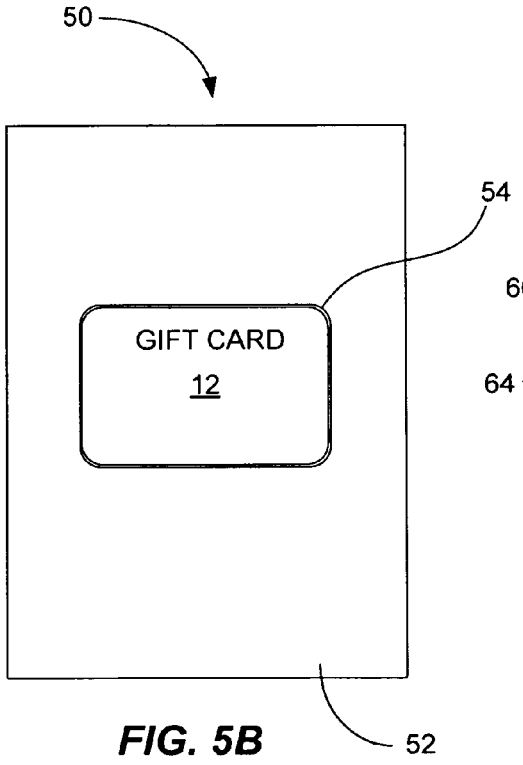
Figure 5C:
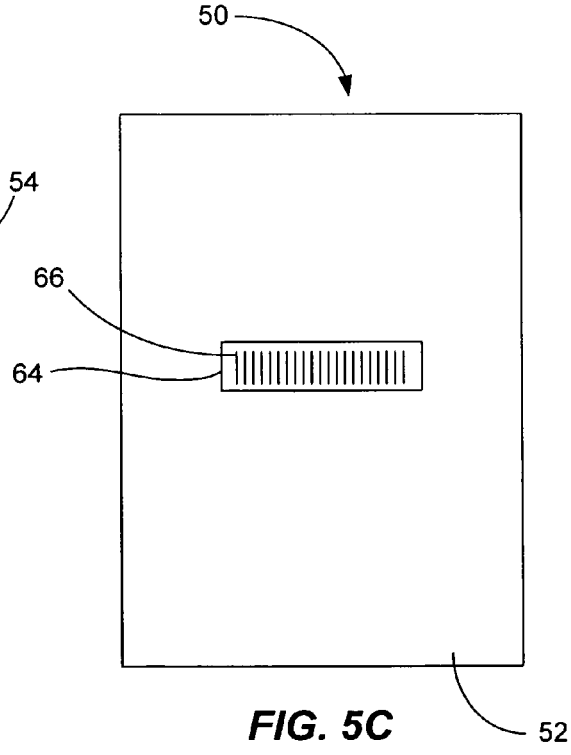

FIGS. 5A-5C are diagrams of a gift card carrier 50, in accordance with one embodiment of the present invention. The gift card carrier 50 may for example correspond to the gift card carriers found on the gift card display of FIG. 1. The gift card carrier 50 includes a panel 52 having a recess or depression 54 for receiving a gift card 56. The recess 54 includes a base portion 58 for supporting the backside of the gift card 56 and side walls 60 that surround the outer edge of the gift card 56 when the gift card 56 is inserted into the recess 54. The size and shape of the recess 54 typically corresponds to the size and shape of the gift card 56 (may include small tolerance therebetween).

The recess 54 may be formed a variety of ways. In one embodiment, the recess 54 is embossed or shaped into the panel 52. In another embodiment, the recess 54 is formed by coupling various layers together with at least the top layer including an opening which forms the side walls 60 and a bottom layer which forms the base portion 58 of the recess 54.

The depth of the recess 54 may be widely varied. The depth of the recess 54 may be configured to place the top surface 57 of the gift card 56 underneath the top surface 53 of the panel 52 (the entire gift card 56 is disposed within the recess 54). In this particular case, the depth of the recess 54 is generally greater then the thickness of the gift card 56. The depth of the recess 54 may also be configured to place the top surface 57 of the gift card 56 above the top surface 53 of the panel 52 (the gift card 56 is partially retained within the recess 54). In this particular case, the depth of the recess 54 is generally smaller than the thickness of the gift card 56. The depth of the recess 54 may also be configured to place the top surface 57 of the gift card 56 substantially flush or level with the top surface 53 of the panel 52 (at least a majority of the gift card 56 is disposed within the recess 54). In this particular case, the depth of the recess 54 is generally substantially equal to the thickness of the gift card 56. In most cases, the depth is typically configured to make the gift card 56 appear as though it is flush mounted within the panel 52. For example, slightly recessed, level or slightly protruding.

The gift card carrier 50 also includes one or more retention mechanisms 62 disposed within the recess 54. The retention mechanisms 62 are configured to hold the gift card 56 within the recess 54. The retention mechanisms 62 may for example include glue, tape, clips, slits, lips, pockets and/or the like. In the illustrated embodiment, a first retention mechanism 62A is placed at an upper area of the base portion 58 and a second retention mechanism 62B is placed at a lower area of the base portion 58. By way of example, the retention mechanisms 62A and 62B may be double sided tape.

Although not a requirement, the gift card carrier 50 may additionally include a scan window 64 disposed within the recess 54. The scan window 64, which is typically a small opening formed in the base portion 58, provides access to the back surface of the gift card 56 when the gift card 56 is placed within the recess 54. The scan window 64 may for example provide access to a scan bar 66 disposed on the back surface of the gift card 56. The scan bar 66 may for example be a magnetic strip or bar code. The scan window 64 is typically sized and dimensioned to expose the entire scan bar 66. As such, the gift card 56 doesn't have to be removed when the gift card is purchased.

Figure 6A:
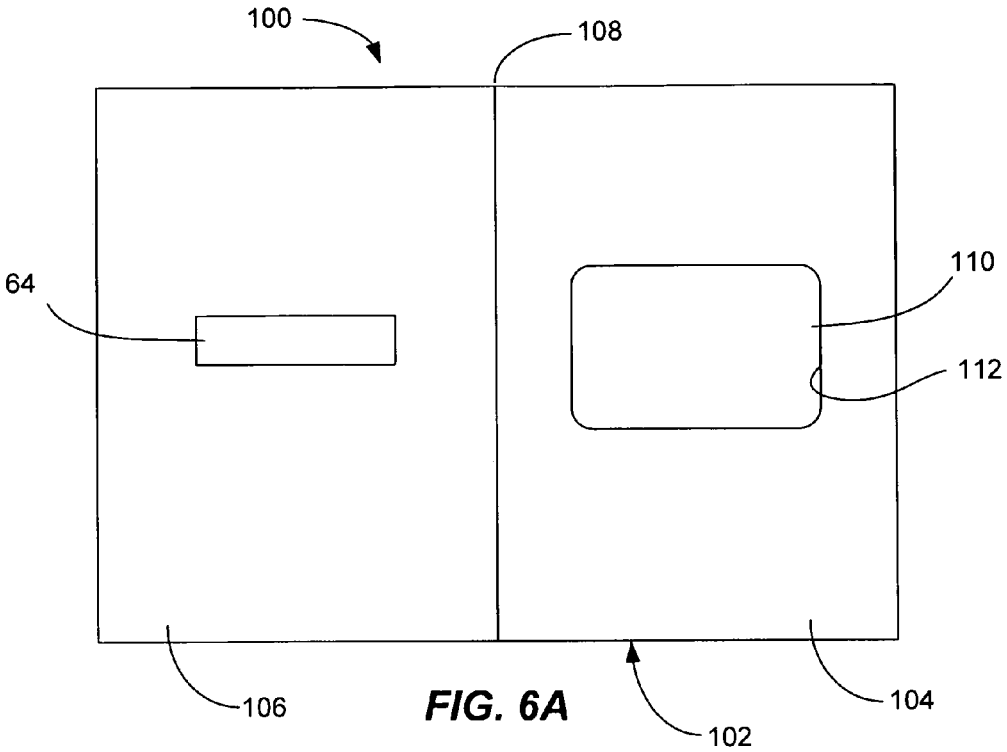
FIGS. 6A and 6B are diagrams of a gift card carrier, in accordance with another embodiment of the present invention.
Figure 6B:
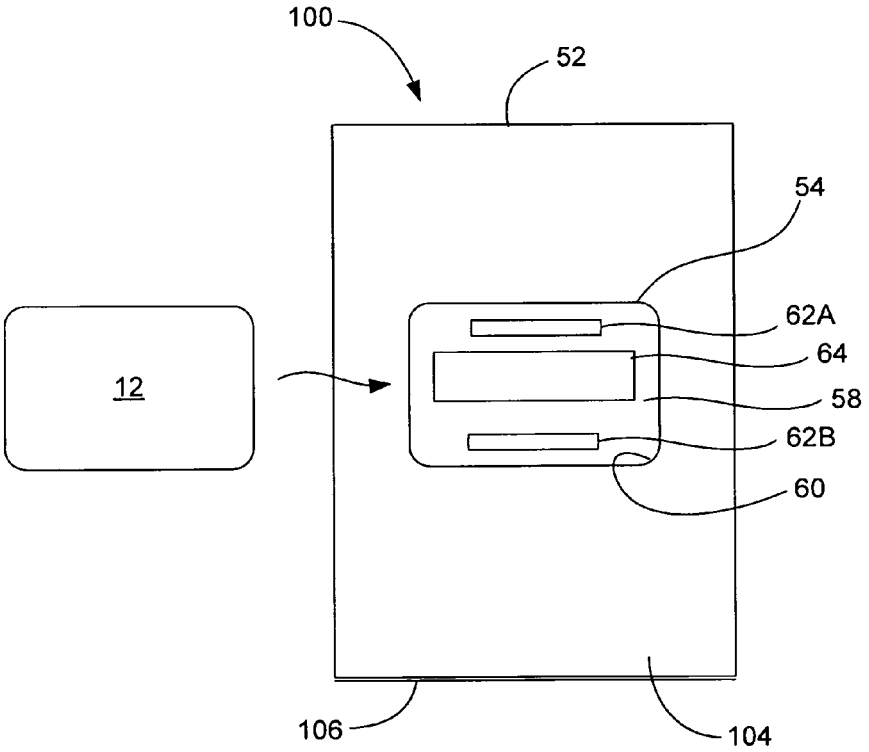

FIGS. 6A and 6B are diagrams of a gift card carrier 100, in accordance with another embodiment of the present invention. The gift card carrier 100 is similar to the gift card carrier 50 described in FIGS. 5A-5C in that it includes a panel 52 with a recess 54 formed therein. In this embodiment, the panel 52 is formed from a single sheet 102 which has a first portion 104 folded over a second portion 106 at a fold line 108, and which uses some sort of adhesive disposed between the first portion 104 and second portion 106 to attach the first portion 104 and second portion 106 together. In some cases, the first portion 104 has the same or equal dimensions as the second portion 106 (as shown) while in other cases the first portion 104 has different dimensions as the second portion 106. For example, it may have a width greater then or less than the width of the second portion and/or a height greater than or less than the height of the second portion.

As shown, the first portion 104 includes an opening 110 having a size and shape that substantially matches the size and shape of a gift card 56. When the first portion 104 is attached to the second portion 106, the opening 110 and second portion 106 cooperate to form the recess 54. Particularly, the edges 112 of the opening 110 form the side walls 60 of the recess 54 while the second portion 106 forms the base portion 58 of the recess 54. Although not a requirement, the second portion 106 may additionally include a scan window 64, which is an opening through the second portion 106. The scan window 64 of the second portion 106 is preferably aligned with the opening 110 of the first portion 104 so that when the gift card 56 is placed in the recess 54, the scan bar located on its backside of the gift card 56 is positioned in its entirety within the scan window 64.

Although the gift card carrier 100 is described as being formed from a single sheet member, it should be appreciated that this is not a limitation. For example, the panel 52 may be formed from two separate sheets that are attached together rather than being folded over each other. In this implementation, the sheets may be formed from the same or different materials and/or with sheets of varying thickness. For example, the first portion 104 may be formed from a first material and the second portion 106 may be formed from a second material. Alternatively or additionally, the first portion 104 may be formed from a first thickness and the second portion 106 may be formed from a second thickness. For example, the thickness of the first portion 104 may be greater than the thickness of the second portion 106 or alternatively the first portion 104 may have a thickness that is less than the second portion 106. The thickness of each portion generally depends on the desired needs of the carrier 100. In one implementation, the thickness of the first portion 104 substantially corresponds to the thickness of the gift card 56 in order to implement flush mounting.

Figure 7:
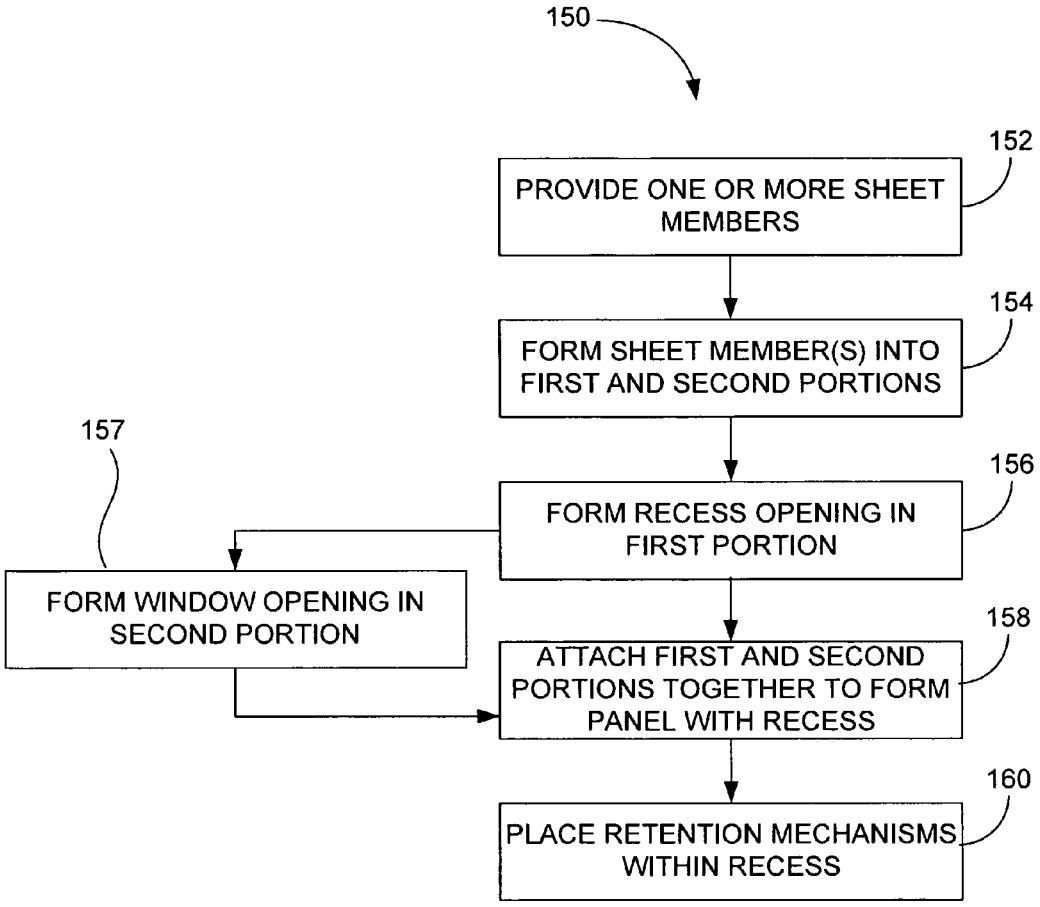
FIG. 7 is a method of manufacturing a gift card carrier having a depression or recess for receiving a gift card, in accordance with one embodiment of the present invention.

FIG. 7 is a method 150 of manufacturing a gift card carrier having a depression or recess for receiving a gift card, in accordance with one embodiment of the present invention. The method may for example be used to manufacture the gift card carrier disclosed in FIGS. 6A and 6B.

The method 150 generally begins at block 152 where one or more sheet members are provided.

In block 154, the sheet members are formed into a first portion and a second portion. The first and second portions may be integrally connected and folded into multiple portions or they may be formed from separate sheets.

In block 156, a recess opening is formed in the first portion. For example, an opening is cut in the first portion (e.g., die cut). The opening is preferable shaped and sized similarly to the outer perimeter of the gift card.

In block 158, the first portion and second portion are attached together to form a panel having a depression or recess formed therein (e.g., the edges of the recess opening and second portion that spans across or covers the recess opening creates a depression, void or recess). By way of example, an adhesive may be applied to one or both of the interfacing surfaces and then the portions may be forced together thereby forming a single laminate panel. This may for example be accomplished by folding over or pressing one over the other.

The method 150 may include an optional block 157 where a window opening is formed in the second portion. The window portion is generally positioned so that it falls within the perimeter of the recess opening when the two portions are attached together. The window opening may for example provide access to the back surface of the gift card when the gift card is placed within the recess. By way of example, the window opening may be a scan window shaped, sized and positioned to expose in its entirety a scanning bar on the back surface of the gift card so that it can be scanned when the gift card is mounted in the recess.

The method 150 may additionally include block 160 where a retention mechanism is placed within the recess. The retention mechanism may for example be double sided tape that is applied to the second portion that spans across or covers the recess opening (e.g., the region of the second portion found within the recess). In one example, double sided tape is applied above and below the window opening.

Once completed, the gift card can be placed in the recess of the panel so that it can be presented for viewing.

It should be noted that the order in which the blocks are performed is not necessarily a limitation (depends on the block). For example, the first and second portions may be formed after the recess opening is formed or after two sheets are attached together (e.g., may be cut away from a larger sheet).

Figure 8A:
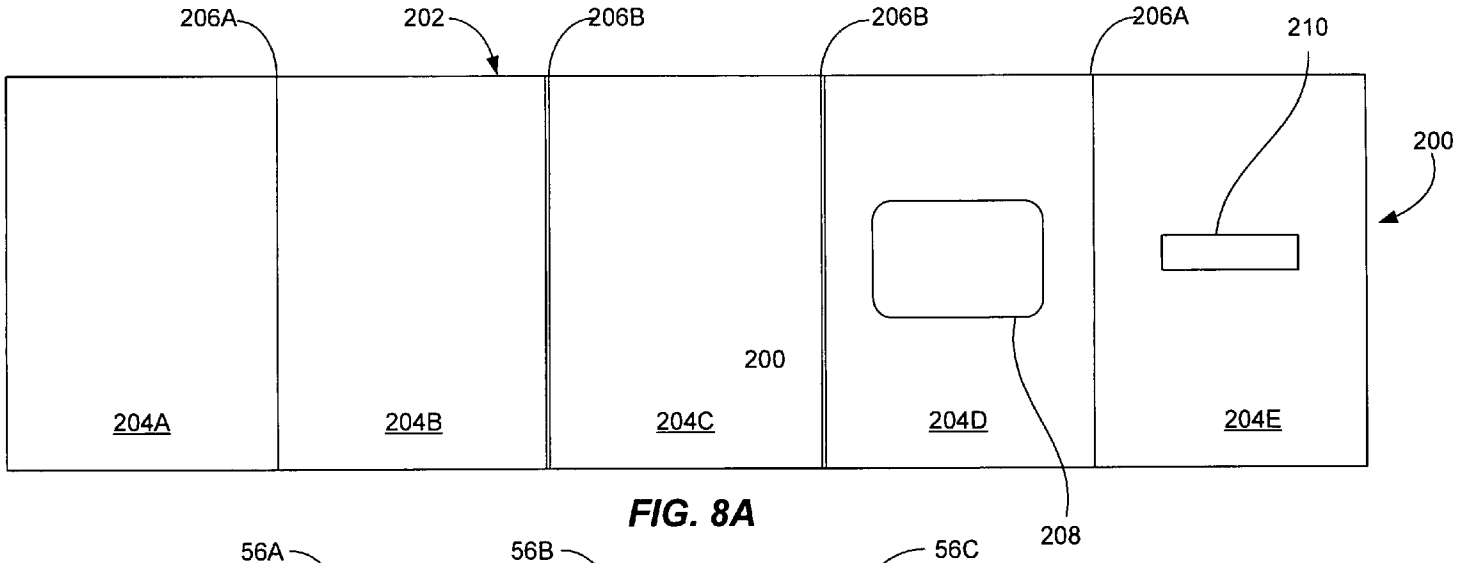
FIGS. 8A and 8B are diagrams of a gift card carrier, in accordance with another embodiment of the present invention.
Figure 8B:
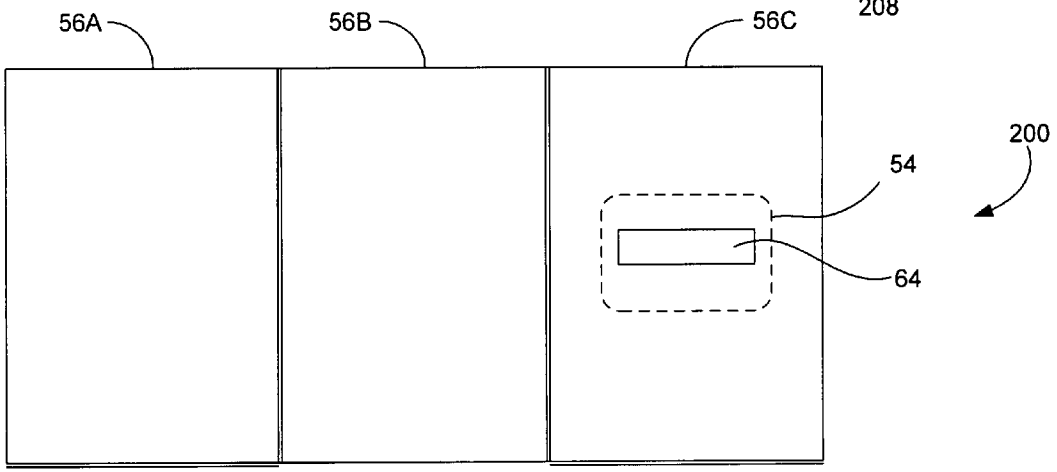

FIGS. 8A-8C are diagrams of a gift card carrier 200, in accordance with another embodiment of the present invention. The gift card carrier 200 is similar to the gift card carrier 50 and 100 described in FIGS. 5-6 in that it includes a panel 52C with a recess 54 formed therein. In this embodiment, the gift card carrier 200 is formed as a greeting card and therefore it includes additional panels 52 that pivot relative to one another. For example, it may include two pivotable panels or three pivotable panels 52A, 52B and 52C (as shown) such that the gift card 56 can be covered as for example by placing adjacent panels 52 together. That is, the panels 52 swing between an open position where the gift card 56 is presented for viewing and a closed position where the gift card 56 is hidden from view. The arrangement may be similar to the arrangement described in FIGS. 2 and 3.

As shown in FIG. 8A, the multiple panel gift card carrier 200 is formed from a single elongated sheet member 202 that has been divided into 5 substantially equal sized sections 204A-E. The five sections 204A-E include a first section 204A, a second section 204B, a third section 204C, a fourth section 204D and a fifth section 204E moving from left to right along the elongated sheet member 200. The fourth section 204D includes a first opening 208 and the fifth section 204E includes a second opening 210. The first opening 208 has a shape that substantially matches the shape of a gift card 56. The first opening 208 is centered within the fourth section 204D. The second opening 210 on the other hand has an elongated shape that substantially matches the shape of a scanning bar located on the back surface of the gift card 56 (plus tolerances so that the scanning bar is completely exposed). The second opening 210 is positioned within the fifth section 204D.

Furthermore, between each of the sections 204 is a fold line 206. A single fold line 206A is provided between the first and second sections 204A and 204B and between the fourth and fifth sections 204D and 204E while a double fold line 206B is provided between the second and third sections 204B and 204C and the third and fourth sections 204C and 204D. The single fold line is sized for a single fold. The double fold line is sized for a double fold. It is designed to account for panels with increased thickness. This will become apparent with the discussion below.

As shown in FIG. 8B, the outer sections particularly the first section 202A and fifth section 202E are folded over and attached to adjacent inner sections particularly the second 202B and fourth section 202D, respectively. This forms two double paned outer panels 52A and 52C on the sides of a central single pane panel 52B. The double fold lines 206B allow each of the double paned outer panels 52A and 52C to swing and be positioned adjacent the central panel 52B (closed). The right outer panel 52C swings left into the central panel 52B and the left outer panel 52A swings right into the central panel 52B.

This arrangement also forms a recess 54 on the back surface of the right outer panel 52C, and a scan window 64 on the front surface of the right outer panel 52C. The scan window 64, which is smaller in area than the recess 54, is positioned within the confines or edges of the recess 54. Its position within the recess 54 is dependent on the location of the scanning bar on the gift card 56. In fact, the side walls 60 of the recess 54 may be used as an alignment mechanism for aligning the scanning bar of the gift card 56 with the scan window 64 on the right outer panel 52C.

The recess 54 further includes one or more retention mechanisms 62 for securing the gift card 56 to the right outer panel 52C when the gift card 56 is placed within the recess 54. In one embodiment, the retention mechanism 62 is double sided tape disposed on the portion of the fifth section 204E contained within the confines of the first opening 208. The double sided tape may for example extend parallel to the scan window at positions below and above the scan window 64.

In order to close the gift card carrier 200 embodied as a greeting card, the right outer panel 52C is swung into the central panel 52B, which places the gift card 56 mounted within the recess 54 in a position for viewing. Thereafter, the left outer panel 52A is swung into the right outer panel 52C to cover the gift card 56 and hide it from view. When closed, the greeting card carrier 200 may be placed in an envelope. In order to open the gift card carrier 200 embodied as a greeting card, the left outer panel 52A is swung away from the right outer panel 52CA thereby presenting the gift card 56 to the recipient of the greeting card carrier 200. In order to display the gift card, the left outer panel 52A may further be folded back around on the other side of the central panel 52B. This arrangement is similar to that discussed in FIGS. 2 and 3.

Figure 9:
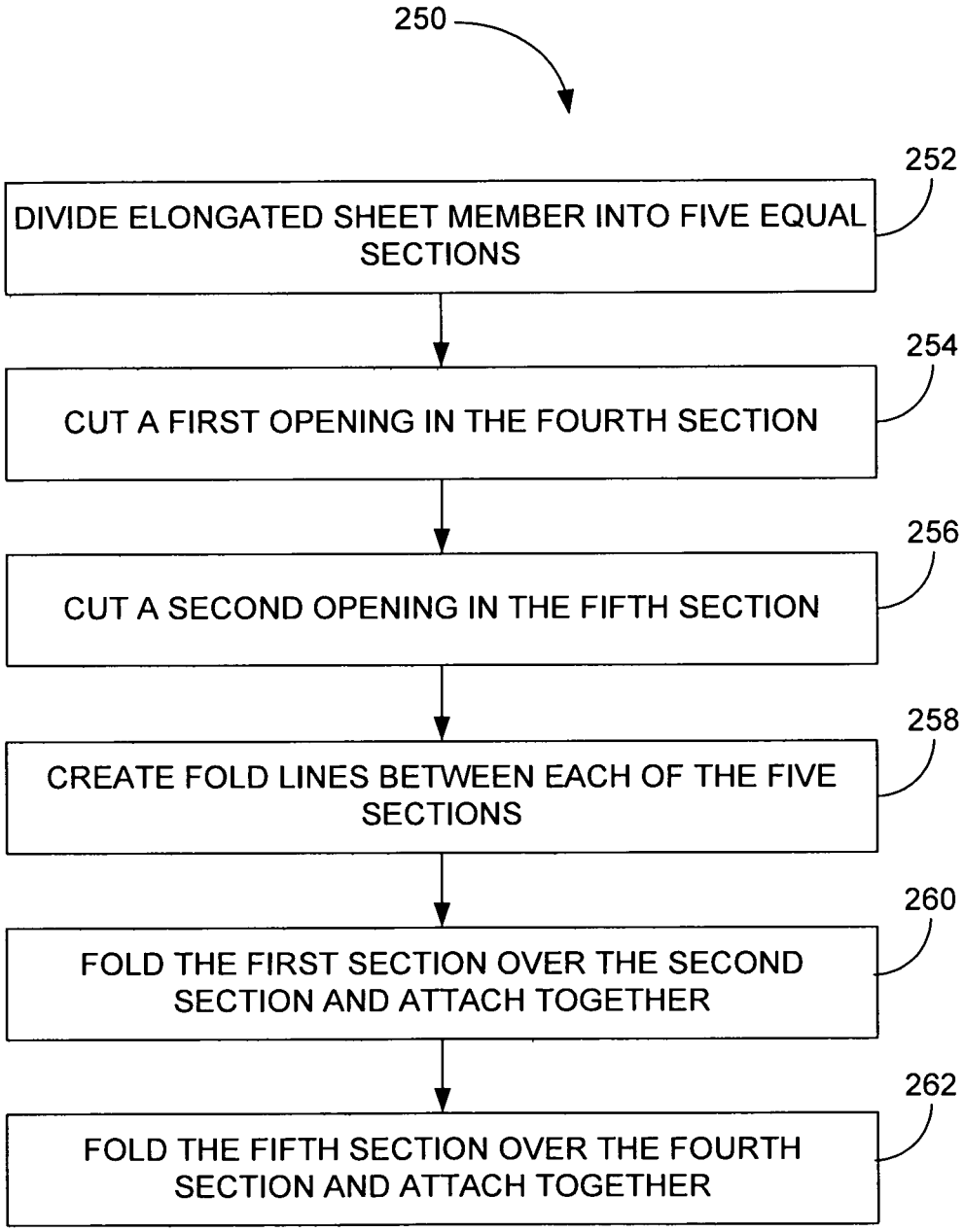
FIG. 9 is a method of manufacturing a gift card carrier, in accordance with one embodiment of the present invention.

FIG. 9 is a method 250 of manufacturing a gift card carrier, in accordance with one embodiment of the present invention. The method may for example be used to manufacture the gift card carrier disclosed in FIGS. 8A and 8B.

The method begins at block 252 where an elongated sheet member is divided into at least five equal sections. The five sections include a first section, a second section, a third section, a fourth section and a fifth section that are consecutively adjacent one another.

In block 254, a first opening is cut in the fourth section. The first opening is sized and shaped to receive a flat gift card therein. The inner edges of the first opening are configured to surround the outer edge of the flat gift card. By way of example, the first opening may be die cut.

In block 256, a second opening is cut in the fifth section. The second opening is sized and shaped to accommodate a scanning bar of a gift card. By way of example, the first opening may be die cut.

In block 258, fold lines are created between each of the five sections. Various sized fold lines may be implemented depending on the needs of the carrier.

In block 260, the first section is folded over the second section, and attached to the second section. By way of example an adhesive such as glue may be disposed between the interfaces of the first and second sections.

In block 262, the fifth section is folded over the fourth section, and attached to fourth section. By way of example an adhesive such as glue may be disposed between the interfaces of the first and second sections. The first opening in the fourth section and a portion of the fifth section cooperate to form a recess for receiving a gift card therein when the fifth and fourth sections are attached. The second opening forms an access opening within the recess. The second opening may for example provide access to the back surface of the gift card in the area of a scanning bar.

According to a third aspect of the invention, a gift card carrier with an image of hardware device that includes a display disposed thereon is provided. The hardware device may for example correspond to media players, computers, monitors, cellular phones, PDAs, televisions, etc. The gift card is mounted over the display region of the hardware device making it appear as if the image disposed on the gift card is being displayed on the imaged hardware device. The gift card image may be associated with the hardware device, and more particularly with images that are normally displayed on the hardware device. By way of example, if the hardware device plays media items such as audio and video, then the image on the gift card may be an image associated with a particular media item such as album art, movie poster art, music video art, TV art, performers, etc. Alternatively, the gift card image may be associated with a GUI screen shot. It may also be associated with an advertising campaign associated with the hardware device. For example, in the case of the iPod music player manufactured by Apple Computer of Cupertino, Calif., the image found on the gift card may be a darkened silhouette of a dancing person listening to a white iPod, all on a colored background such as blue.

Figure 10A:
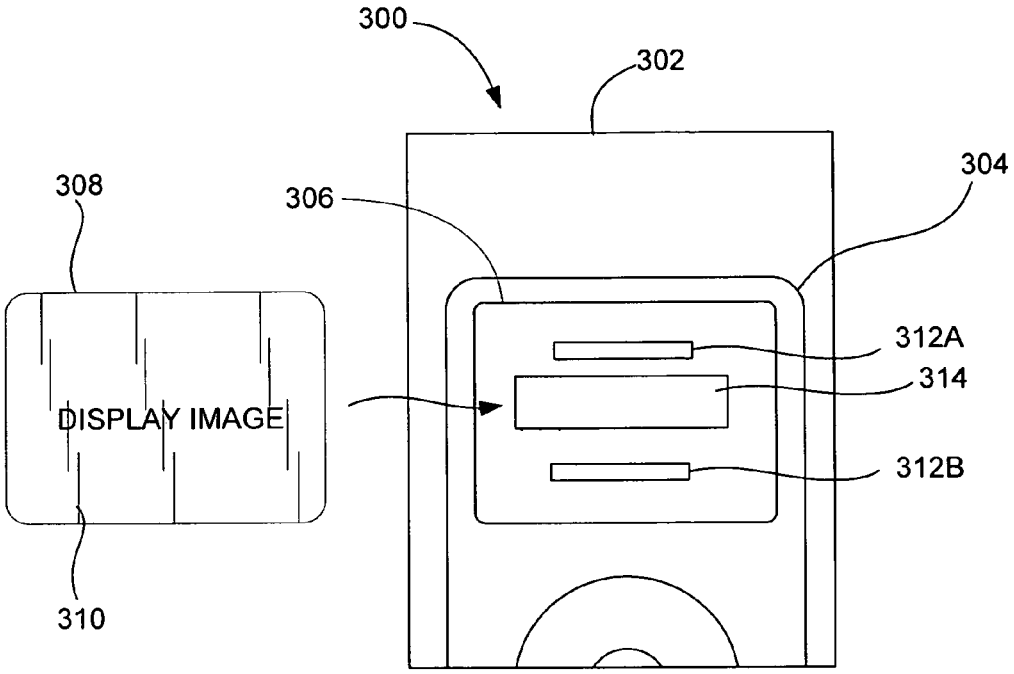
FIGS. 10A and 10B are diagrams of a gift card carrier, in accordance with another embodiment of the present invention.
Figure 10B:
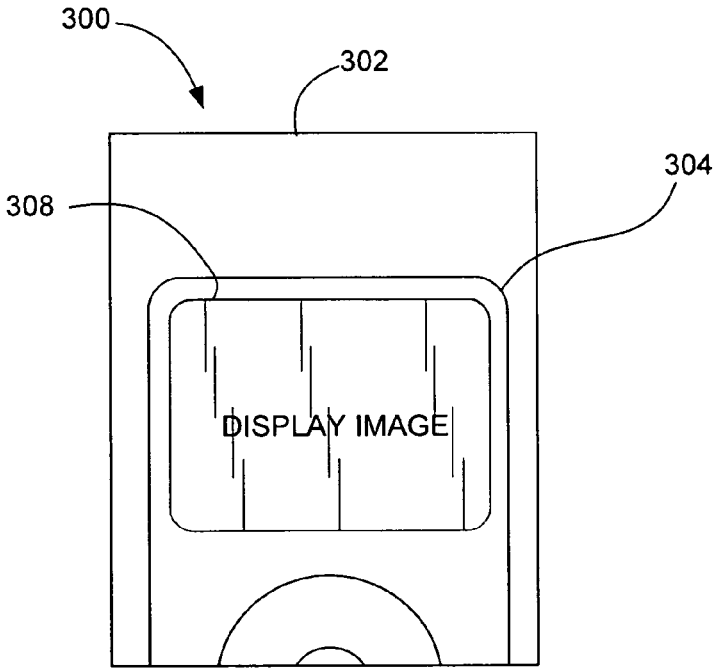

FIGS. 10A and 10B are diagrams of a gift card carrier 300, in accordance with another embodiment of the present invention. The gift card carrier 300 may for example correspond to the gift card carriers found on the gift card display of FIG. 1. The gift card carrier 300 includes a panel 302 having a hardware image 304 disposed thereon. The image may for example be printed or glued or otherwise applied to the panel. The hardware image 304 may for example be printed on the front surface of the panel 302. The hardware image 304 is configured to represent a particular piece of physical hardware device that is capable of displaying images as for example via a display. The hardware image 304 therefore includes at least a display region 306 of the hardware device. In some cases, the entire hardware image 304 is disposed on the panel 302. In other cases, only a portion of the hardware image 304 disposed on the panel 302.

The hardware image 304 may be a photo image (modified or unmodified), a drawing, and/or other suitable art form or graphic. Furthermore, the hardware image 304 may be an image of a consumer electronic product. By way of example, the hardware image 304 may be a media player such as a music player, video player, and/or game player. It may also be a computer such as a laptop, desktop, monitor or the like. It may also be a portable handheld device such as a GPS, PDA, smart phone and/or cellular phone. It may also be a stereo, television or the like.

The hardware images may be widely varied. They typically depend on the products offered by the issuing company. Generally speaking any consumer electronic product. In one particular embodiment, the hardware image is an image of a media player such as an iPod manufactured by Apple Computer Inc. of Cupertino Calif. In another particular embodiment, the hardware image is an image of a computer such as the iMac or Mac Pro family of computers manufactured by Apple Computer Inc. of Cupertino Calif. In another particular embodiment, the hardware image is an image of a monitor with or without a related computer as for example the Apple Cinema Display and Mac Pro manufactured by Apple Computer Inc. of Cupertino Calif. Other hardware products include cellular phones, PDAs, televisions, stereos, and the like.

As shown, a gift card 308 is configured to be mounted to the panel 302 in the region of the display region 306 and in most cases directly over the display region 306. Generally speaking the display region 306 and gift card 308 have substantially the same size or aspect ratio. However, the display region 306 be made slightly smaller than the gift card 308 so that the gift card 308 hides the display region 306 when the gift card 308 is mounted to the panel 302. In some cases, the display region 306 may be formed as a recess as shown in FIGS. 5, 6 and 8.

Furthermore, like the panel 302, the gift card 308 also has an image 310 disposed thereon. The image may for example be printed or glued or otherwise applied to the panel. The image 310 on the gift card 308 is configured to be associated with the imaged hardware device and more particularly the images that can be displayed and that more particularly are normally displayed on the hardware device 304 imaged on the panel 302. Thus, when the gift card 308 is attached, the gift card image 310 appears as if its being displayed by the hardware device image 304.

The gift card images may also be widely varied. Generally speaking, the image disposed on the gift card has some relation, link or connection to the hardware device. Like the hardware image, the gift card image may be a photo based image, a drawing or other suitable graphic.

In a primary embodiment, the gift card image is associated with media content that can be downloaded to and played on the hardware device. For example, the gift card image may include images associated with TV shows, movies, music videos, music albums, games, which may be purchased at a store (e.g., online or brick and mortar) that issues the gift card. By way of example, the image may be TV poster art, movie poster art, music video art, album art, game art, book art, etc. Alternatively or additionally, the images may be duplicate images from the media content itself (e.g., scenes from a movie). Alternatively or additionally, the images may be a performer(s) associated with the media items (e.g., actors, musicians, anchors, radio hosts, etc.). "LOST" and "DESPARATE HOUSEWIVES" are examples of TV shows while "CARS" and "CADDYSHACK" are examples of movies.

As should be appreciated, the online iTunes store of Apple Computer Inc., now offers TV shows, movies, music videos, music albums, games, podcasts, for download to computers and media players and thus images of those offerings may be placed on the gift card associated with the online iTunes store of Apple Computer Inc. In fact, the images found on the gift card may generally correspond to the icon images found at the online store.

In alternate embodiment, the gift card image is associated with GUI screen shots of the hardware device. For example, the gift card image may include images associated with operating systems, applications, and the like running on the hardware device. With regards to the iPod for example the main menu or media lists may be placed on the gift card. With regards to the iMac, applications such as iTunes, iPhoto, iMovie, Garage Band may be placed on the gift card.

In alternate embodiment, the gift card image is associated with one or more accessories of the hardware device. For example, in the case of a computer, the gift card image may be a web cam, printer, keyboard, mouse, speakers, external hard drive, etc. The gift card image may also be an image of software that can be downloaded onto the computer (e.g., software book jacket). In the case of a media player, the gift card image may be lanyards, docking stations, exercise straps, cases, microphones, earphones, FM transmitters, and the like.

In alternate embodiment, the gift card image is associated with the company issuing the gift card and/or the manufacturer of the hardware device. For example, logos, symbols or characters of the company issuing the card. Alternatively, web sites and online stores offered by the company issuing the card.

In alternate embodiment, the gift card image is associated with an advertising campaign associated with the manufacturer or the particular hardware device. For example, images from TV commercials may be disposed on the gift card.

In alternate embodiment, the gift card image is associated with other products offered by the manufacturer of the hardware device or the issuer of the gift card.

In alternate embodiment, the gift card image is associated with partner companies and websites related to the manufacturer of the hardware device or the issuer of the gift card.

The gift card carrier 300 also includes one or more retention mechanisms 312 disposed within the display region 306 of the hardware image 304. The retention mechanisms 312 are configured to hold the gift card against the display region 306 of the panel 302. The retention mechanisms 312 may for example include glue, tape, clips, slits and/or the like. In the illustrated embodiment, a first retention mechanism 312A is placed at an upper area of the display portion 306 and a second retention mechanism 312B is placed at a lower area of the display portion 306. By way of example, the retention mechanisms 312 may be double sided tape.

Although not a requirement, the gift card carrier 300 may additionally include a scan window 314 disposed within the display portion 306. The scan window 314, which is typically a small opening formed in the display portion 306, provides access to the back surface of the gift card when the gift card is mounted to the panel 302 over the display region 306. The scan window 314 may for example provide access to a scan bar disposed on the back surface of the gift card. The scan bar may for example be a magnetic strip or bar code. The scan window 314 is typically sized and dimensioned to expose the entire scan bar. As such, the gift card doesn't have to be removed when the gift card is purchased.

Figure 11:
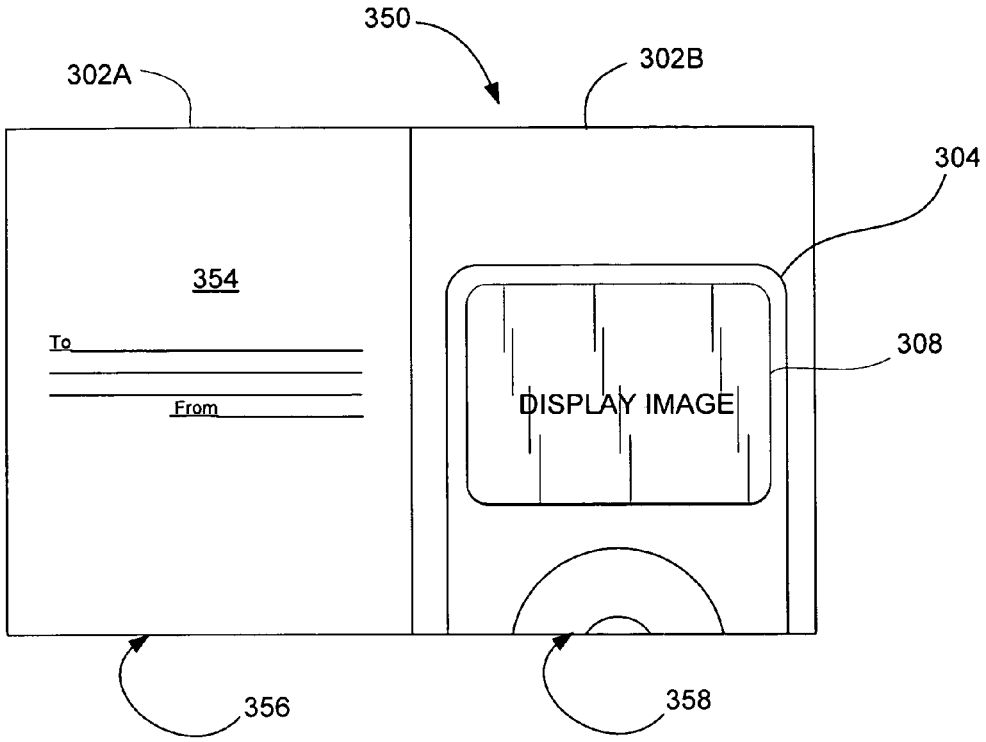
FIG. 11 is a diagram of a gift card carrier, in accordance with another embodiment of the present invention.

FIG. 11 is a diagram of a gift card carrier 350, in accordance with another embodiment of the present invention. The gift card carrier 350 is similar to the gift card carrier 300 described in FIG. 10 in that it includes a panel 302 with a hardware image 304 formed therein and a gift card 308 associated with the hardware image 304 mounted over a display region 306 of the hardware image 304. In this embodiment, the gift card carrier 350 is formed as a greeting card and therefore it includes additional panels 302 that pivot relative to one another. For example, it may include two pivotable panels 302A and 302B (as shown) or three pivotable panels such that the gift card can be covered as for example by placing adjacent panels 302 together. That is, the panels 302 swing between an open position where the gift card is presented for viewing and a closed position where the gift card is hidden from view. When closed, the greeting card carrier 350 may be placed in an envelope. This arrangement may be similar to the arrangement described in FIGS. 2 and 3.

To make it appear more greeting card like, the left panel 302 opposite the right panel 302 that includes the hardware image 304 may include a message area 354. The message area 354 may include a printed message or greeting similar to a greeting card. The message area 354 may also include an area where a purchaser can write a message or sign their name. In the illustrated embodiment, the message area 354 includes a message header having several lines dedicated to "To" and "From", which can be filled in by the purchaser. A cover message or header 356 may be placed on the back side of the left panel 302. The cover header 356 may for example include a symbol associated with the store issuing the gift card. An agreement message 358 may be placed on the backside of the right panel 302. The agreement message 358 may for example lay out the terms and conditions associated with the gift card. It may also spell out how to use the gift card. It may also include a bar code.

Figure 12:
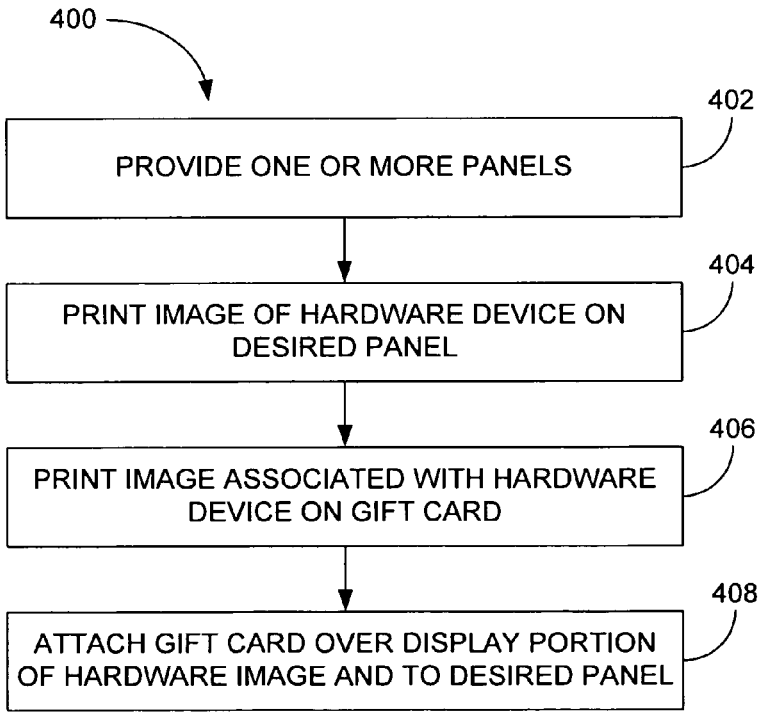
FIG. 12 is a method of manufacturing a gift card carrier in accordance with one embodiment of the present invention.

FIG. 12 is a method 400 of manufacturing a gift card carrier in accordance with one embodiment of the present invention. The method may for example be used to create the gift card carriers disclosed in FIGS. 10 and 11.

The method 400 generally begins at block 402 where one or more panels are provided.

In block 404, an image of a hardware device is printed on a desired panel. At least the region of the hardware device that includes the display of the hardware device is printed on the desire panel.

In block 406, an image associated with the hardware device is printed on a gift card. The gift card image may for example be images that represent media items that can be played on the hardware device. The media images may be associated with audio (music, books, podcasts, etc.), videos (movies, music videos, podcasts, television shows, etc.), games, and the like. By way of example, the images may be images of performers, title, posters, artwork, scenes, etc. that are related to the audio, video or games.

In block 408, the gift card associated with the hardware device is attached to the desired panel over the display region of the hardware image.

Figure 13:
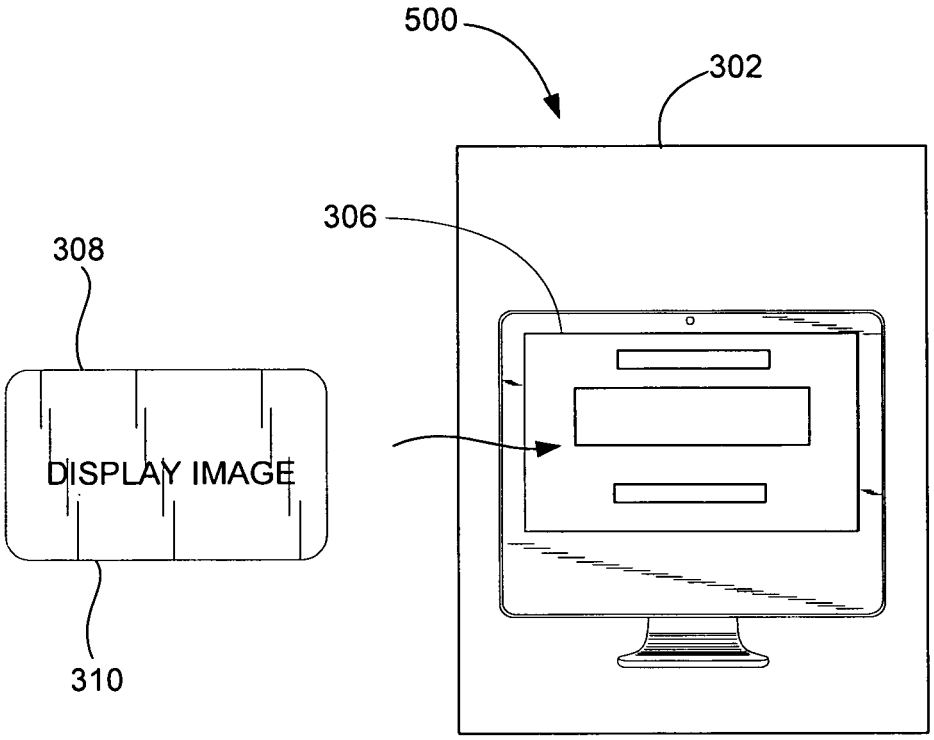
FIG. 13 is a diagram of gift card carrier, in accordance with another embodiment of the present invention.

FIG. 13 is a diagram of gift card carrier 500, in accordance with another embodiment of the present invention. The gift card carrier 500 is similar to the gift card previously described. However, unlike the gift card carrier previously described, the panel of the gift card carrier includes an image of a computer or display rather than a media player.

While this invention has been described in terms of several preferred embodiments, there are alterations, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

What is claimed is:

1. A gift card carrier, comprising:

a panel having a surface with a hardware image disposed thereon, the hardware image representing at least a portion of a hardware device, the portion of the hardware device that is imaged on the panel including a display region of the hardware device; and a recessed portion on the surface of the panel, the recessed portion being disposed in the display region of the hardware image and defining an area for mounting a gift card, wherein, when a gift card is mounted in the recessed portion, the gift card is flush with the surface of the panel and the gift card appears to be displayed on the display region of the hardware image.

2. The gift card carrier as recited in claim 1 wherein the display region of the hardware image has substantially the same size and shape of a gift card.

3. The gift card carrier as recited in claim 1 wherein the display region of the hardware image is slighty smaller than the size of a gift card.

4. The gift card carrier as recited in claim 1 further comprising one or more retention mechanisms disposed on the panel in the display portion of the hardware image, the one or more retention mechanisms being configured to hold a gift card against the panel and over the display portion.

5. The gift card carrier as recited in claim 1 further comprising a scan window disposed through the panel in the display portion of the hardware image.

6. The gift card carrier as recited in claim 1 wherein the hardware image represents a media player, computer, monitor, cell phone, PDA, or television.

7. A gift card carrier, comprising:

a panel having a front surface with an image of a hardware device capable of displaying digital images disposed thereon, the image of the hardware device including at least a display region of the hardware device;

a gift card mounted to the front surface of the panel over the display region of the image of the hardware device, the gift card having a front surface with an image disposed thereon, the image being related to the image of the hardware device; and a recessed portion on the first front surface of the panel in the display region of the hardware image, the recess portion defining an area for mounting the gift card, wherein, when a gift card is mounted in the recessed portion, the gift card is flush with the front surface of the panel and the gift card appears to be displayed on the display region of the hardware image.

8. The gift card carrier as recited in claim 7 wherein the image disposed on the front surface of the gift card is associated with content that is displayable on the hardware device.

9. The gift card carrier as recited in claim 7 wherein the image disposed on the front surface of the gift card is associated with media content that can be played on the hardware device.

10. The gift card carrier as recited in claim 7 wherein the media content is associated with TV shows, movies, music, music videos, podcasts, or games.

11. The gift card carrier as recited in claim 7 wherein the image disposed on the front surface of the gift card is associated with GUI screen shots or applications that can be displayed on the hardware device.

12. The gift card carrier as recited in claim 7 wherein the hardware device is a portable handheld device.

13. The gift card carrier as recited in claim 7 wherein the hardware device is selected from a media player, computer, monitor, cell phone, PDA, or Television.

14. The gift card carrier as recited in claim 7 further comprising one or more retention mechanisms disposed on the panel in the display region of the image of the hardware device, the one or more retention mechanisms being configured to hold a gift card against the panel and over the display region.

15. The gift card carrier as recited in claim 7 further comprising a second panel that folds relative to the first panel so that the gift card carrier operates as a greeting card.

16. The gift card carrier as recited in claim 15 wherein the gift card carrier is placed in a first folded configuration so that a gift card retained within the recess is presented for view, and wherein the gift card carrier is placed in a second folded configuration so that a gift card retained within the recess is hidden from view.

17. The gift card carrier as recited in claim 7 wherein the panel includes a recessed portion sized and dimensioned to receive the gift card therein so that the gift card appears to be flush mounted when the gift card is positioned inside the recessed portion of the panel, the recessed portion being positioned at the location of the display region of the image of the hardware device so that a gift card retained therein appears to be displayed in the display region of the image of the hardware device.

* * * * *